US008672585B2

(12) United States Patent
Schnaars, Sr. et al.

(10) Patent No.: US 8,672,585 B2
(45) **Date of Patent: *Mar. 18, 2014**

(54) FLOOD WALL PROTECTION SYSTEM

(75) Inventors: Daniel R. Schnaars, Sr., Lafayette, LA (US); Everett Leslie Waid, Jr., Ft. Myers, FL (US); Jean Andre Beard, Lafayette, LA (US)

(73) Assignee: Ameriglobe, LLC, Lafayette, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/364,114

(22) Filed: Feb. 1, 2012

(65) Prior Publication Data

US 2012/0195687 A1 Aug. 2, 2012

Related U.S. Application Data

(60) Provisional application No. 61/438,313, filed on Feb. 1, 2011.

(51) Int. Cl.
*E02B 3/10* (2006.01)

(52) U.S. Cl.
USPC ..... 405/114; 405/111; 405/284; 405/16; 405/17; 405/18

(58) Field of Classification Search
USPC ..... 405/107, 110, 111, 114, 115, 284, 16, 405/17, 18
See application file for complete search history.

(56) References Cited

U.S. PATENT DOCUMENTS

| | | | | |
|---|---|---|---|---|
| 3,213,628 | A * | 10/1965 | Serota | 405/111 |
| 4,692,060 | A * | 9/1987 | Jackson, III | 405/115 |
| 4,807,299 | A * | 2/1989 | Nattrass et al. | 383/109 |
| 5,040,919 | A * | 8/1991 | Hendrix | 405/115 |
| 5,584,599 | A * | 12/1996 | Knittel | 405/108 |
| 5,632,573 | A * | 5/1997 | Baker | 405/114 |
| 5,771,665 | A * | 6/1998 | Nelson et al. | 53/459 |
| 6,164,870 | A * | 12/2000 | Baruh | 405/114 |
| 6,390,154 | B1 * | 5/2002 | Hall | 405/107 |
| 6,551,025 | B2 * | 4/2003 | Dery | 405/115 |
| 6,619,884 | B2 * | 9/2003 | Davis et al. | 405/114 |
| 7,431,534 | B2 * | 10/2008 | Harbeck | 405/114 |

(Continued)

FOREIGN PATENT DOCUMENTS

KR 20-0268953 3/2002

*Primary Examiner* — Frederick L Lagman
(74) *Attorney, Agent, or Firm* — Garvey, Smith, Nehrbass & North, L.L.C.; Gregory C. Smith; Julie M. FitzPatrick

(57) ABSTRACT

A flood wall system and method of constructing same, including providing a first main panel section; attaching sleeves to each side of a main panel prior to configuring the final chamber; providing two sleeves of fabric at the upper opening of each chamber for supporting the chambers while the chambers are being filled with materials such as sane; providing a series of chambers sewn together to define a continuous cellular wall; the final chamber having a horizontal height two feet longer (0.61 meters) than the vertical height further having a front toe portion one foot (0.30 meters) min height; filling each chamber with a quantity of material, such as sand; on each end of a completed chain of chambers, further comprising a set of loops or ties so that a chain of chambers is capable of being tied to other chains of chambers to define the continuous flood wall system.

12 Claims, 12 Drawing Sheets

(56) References Cited

U.S. PATENT DOCUMENTS

| | | | | |
|---|---|---|---|---|
| 7,449,105 | B2 * | 11/2008 | Hastings | 405/115 |
| 7,491,016 | B2 * | 2/2009 | Baruh | 405/114 |
| 7,591,611 | B2 | 9/2009 | Arellanes et al. | |
| 7,651,298 | B2 | 1/2010 | Boudreaux, Jr. | |
| 2007/0140598 | A1 * | 6/2007 | McGillick et al. | 383/22 |
| 2011/0103900 | A1 * | 5/2011 | Adams et al. | 405/284 |

* cited by examiner

Sleeve Construction and attachment

Sleeve Fabric cut 36 x 20 (0.91 x 0.51 m)
Fold to make 36 x 10 (0.91 x 0.25 m)
Fabric tunnel at top should have a
2 inch lay flat. (5.08 cm)
Sleeve should be pre-attached to panel
With three sew lines.
One sew line one inch from bottom (2.54 cm)
One sew line 3 inches higher (7.62 cm)
And last sew line 3 inches higher again.
(7.62 cm)

Main panel construction

Fabric cut 220 inches long with a two inch fold on each end.
(5.59 m)

When attaching to side panels make two inch fabric folds on All edges.

Add Sleeves to side Panels

Sew one main panel to two side panels.

Add one main panel to one completed chamber

Add one main panel
To all chambers so that
Every unit looks like this
One.

Preparing connection chambers

Attach 8 loops inside The seam that attaches The main panel to the Side panel.

Attach 8 loops to the outside edge of the main panel.

(In the field, the complete chamber of the next chain will be placed inside the final main panel and tied together.)

Packing completed chains.

Always pack each chain with main panel with the loops down on pallet first and
The chamber with the ties on top.

Final Packing

- Add cover bag
- Strap to pallet
- Add tag indicating Trap Bag style that is 6 feet tall

FIG. 12

FLOOD WALL PROTECTION SYSTEM

CROSS-REFERENCE TO RELATED APPLICATIONS

In the US, this is a nonprovisional of U.S. Provisional Patent Application Serial No. 61/438,313, filed 01 Feb. 2011, which is hereby incorporated herein by reference.

Priority of U.S. Provisional Patent Application Serial No. 61/438,313, filed 01 Feb. 2011, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to temporary flood walls. More particularly, the present invention relates to a system which utilizes a continuous sleeve that is fitted into each connecting wall. This sleeve provides a stiff and straight support for the entire length of the connecting walls by use of a metal rod which is threaded through the sleeve and supported by the metal rails of the sled or any other hanging device that may be used.

2. General Background of the Invention

The art of building temporary flood walls is well known. The most commonly known method is to fill small bags full of sand and stack them up in a pyramid fashion to hold back flood waters. These small bags weighed between 50 and 100 pounds (between 22.68 and 45.36 kilograms). Building flood walls with this method involves a lot of labor and time.

Other methods involve simply piling truckloads of sand and dirt on top of levees. But while this method is fast, it is prone to washouts as the sand and dirt is uncontained against the flow of water.

Still another method uses open top bulk bags with wooden frames inside them which are bolted together in a cellular fashion to create vertical long walls that are then filled with sand and dirt. It is a fairly fast method for constructing walls but has the expense of the wood and is limited to vertical walls that can be pushed over by fast moving flood waters or collapsed from beneath as the flood waters hollow out the ground beneath them.

Still another method uses specially shaped bags that have triangular shaped sides. These bags are delivered using a large sled device that makes filling easier and faster than the methods listed above. However, this sled device relies on a bag support method that requires special parts to support each bag by its four corners that can be expensive and unreliable. Further the triangular shaped front of the containers are often unfilled due to its pointed toe. Due to the wave action of the flood waters, the sand and dirt can move after placement and cause some loss of control over its shape. And, just as the square bags can be hollowed out from below, so can this triangular faced design.

In short, each of the existing methods of flood control that utilize flexible materials still have shortcomings that need to be addressed.

SUMMARY OF THE PRESENT INVENTION

It is the purpose of this invention to address all of these various shortcomings in a unique and straightforward manner.

This invention still uses flexible fabric to create a continuous cellular wall as does the second two methods above. However, it requires no wood nor any special and unreliable parts to hold it up during the filling process. It has no pointed toes that are difficult to fill. But most importantly, it resolves the problem caused by the flood hollowing out the ground beneath the barrier. By eliminating this particular problem, this invention provides far more security to any property being protected by this barrier wall than any previous method involving flexible fabrics.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 12 is a description of the final packing being done in the system of the present invention.

DETAILED DESCRIPTION OF THE INVENTION

Figure 1:
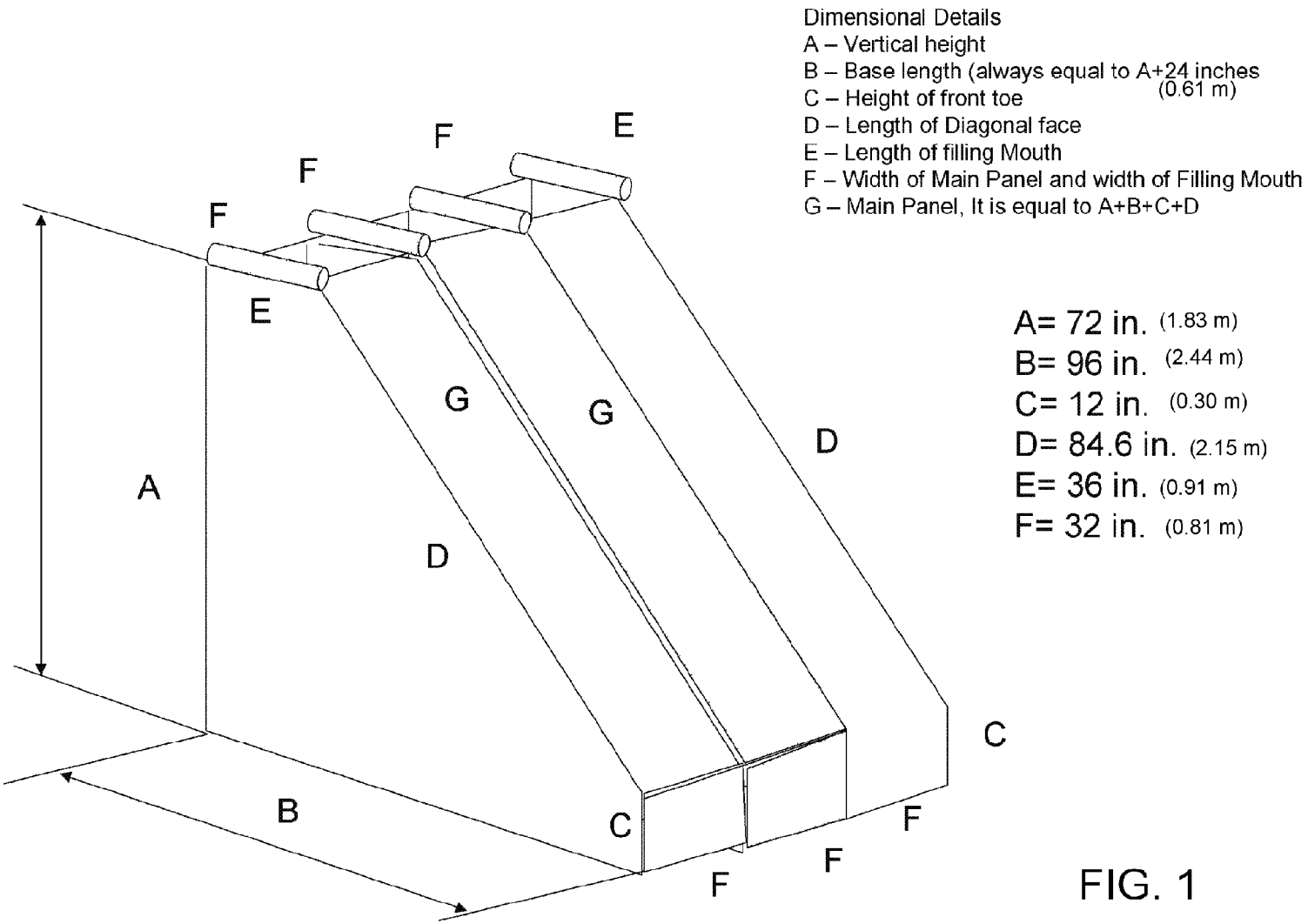
FIG. 1 illustrates an overall view of the preferred embodiment in the system of the present invention.

FIGS. 1-12 illustrate views of the system and the method of constructing the system of the present invention as illustrated and described and in those various drawing figures.

Prior to a discussion of the present invention, it is well known in the art that once flexible fabrics are formed into continuous cellular walls, and filled with sand and dirt, it forms a solid barrier against water. However, filling these flexible containers on banks along rivers and shore lines is not an easy task. The flexible walls must be properly supported until the containers are filled. One such method accomplishes this by using a large metal sled that supports each portion of the cellular wall as it is filled. The sled is then pulled along a horizontal line until it clears the filled cell and new unfilled cells are opened and supported under the sled waiting to be filled.

Existing methods support each cell's corner with a special plastic hangar that is not readily available and is therefore expensive. These plastic hangars can only be used a single time. As two hangars are used every two feet (0.61 meters) of the wall, the costs of these special parts add up over the course of each mile (or kilometer) of wall that is placed. Further, with only the corners supported, there is noticeable sagging of the cellular walls as each cell is filled. This sagging creates uneven tensions on the four holders. The uneven tension can often overload individual hangars and cause them to fail during the movement of the sled.

The individual cells of the wall can be filled with up to 7,000 pounds (3,175.15 kilograms) of sand or dirt. After filling, the sled moves horizontally. The hangars must slide along metal rails until they clear the sled. Under this tremendous weight, these hangars can fail and cause the cells to drop from the sled prematurely.

This invention replaces this method of support with a unique sleeve support system. Instead of four individual plastic hangars that can break and allow connecting walls to sag and misshape, this invention uses a continuous sleeve that is fitted into each connecting wall. This sleeve provides a stiff and straight support for the entire length of the connecting walls by use of a metal rod which is threaded through the sleeve and supported by the metal rails of the sled or any other hanging device that may be used.

This complete support of the connecting wall completely eliminates the sagging during the filling process. It also spreads out the weight of the sand and dirt during the sled movement. The two continuous sleeves maintain their spacing during the movement of the sled and slide evenly along the metal rail supports without failure.

As the cells are filled and cleared from the sled, the metal hanging bars can be easily slid out of the sleeves and re-used by inserting them in the sleeves of unfilled cells. Each metal bar can be re-used hundreds of times making their cost negligible.

This sleeve and bar method can be used on barriers of almost any design. It can be used on both straight sided containers such as bulk bags or it can be used on slope sided containers such as discussed in this invention.

A second feature of this invention is the elimination of the pointed toe that often cannot be filled. As traditional slant sided containers are filled, the angle of repose and the coefficient of friction of the various materials used to fill them, can often prevent the fill materials from reaching the end of the toe. This invention simply eliminates this problem by designing a blunted end of the container and keeping the non-vertical side wall at or near a 45 degree angle.

A third feature of this invention is the use of the 45 degree slanted wall on one side of the flood wall. By sloping the wall facing away from the rising water, the sloped wall adds triangular force to prevent wall collapse. Bags with simple vertical walls are prone to tipping over from the force of the water.

By adding the slope opposite the force of the water, the wall has greater resistance to tipping over than even a similarly based container with vertical walls. As a vertical wall begins to tip, the weight of wall that immediately crosses the vertical position becomes encouragement for the wall to tip over. With a sloped side, there will be no weight crossing the vertical line and encouraging the container to tip over. Further, the center of gravity for the entire container is moved toward the force of the water creating even further resistance to tipping over.

A fourth feature is an optional wave protector. We can add a piece of fabric all along the bottom edge of the side of the bag that is facing the water. This fabric can be partially buried into the ground in front of the cells. Moving water cannot drive through this barrier and undercut the support of the ground from under the bags.

This was an important failure of the Hesco Barriers during the BP oil spill. Rolling waves will be stopped by the fabric barrier and safely run off away from the bag.

The 'back' portion of the sled is the loading portion. In this area the bags are not in the accordion position. They are fully opened up and sized to just reach the ground.

As filling materials are dumped into the top, it falls through the hopper and into the bags. This material is dumped in filling the bags. The filling process continues even after the bags are full until the hopper above is substantially full.

At that point the sled is pulled from the front side by a tractor. As the tractor pulls the sled forward, the filled bags stay in place which means the steel bars slide off the rails on the back side.

Simultaneously, as the sled is pulled forward, the back vertical wall of the sled acts as a leveling and scraping device. It determines the final height of filler material in each bag and creates a wonderfully flat and level barrier wall.

Also simultaneously, as the sled is pulled forward, new cells are pulled open to accommodate the widening distance between the filled cells and the unfilled cells.

Also simultaneously, the filler material, that was on top of and above the cells that were filled initially, is scraped off the filled bags and gravity dropped into the newly opened cells. As long as there is filler material in the trough, the sled continues to be pulled forward.

Once the hopper empties, there are three more cells (still connected to the previously filled cells) sitting under the hopper waiting for more filler materials. The front end loader now starts refilling the hopper and the open cells beneath until the hopper is once again full. The sled is pulled forward again leaving the filled cells in place on the ground and filling newly opened cells.

This is repeated over and over until the entire wall is in place, filled with materials to hold back rising water or mud slides, etc.

In summary, the system, which is referred to at times as The TrapBag, comprises a series of identical chambers that are sewn together to make a continuous cellular wall. The system is constructed by building every other chamber completely, then connecting the completed chambers with a single main panel. A completed set of 31 chambers will be made up of 16 complete chambers and 15 extra main panels. The system is constructed in a series of steps that are all very similar to bulk bag production except the final stage of putting together the chain of bags. Each chamber will have two sleeves of fabric at the top opening of each chamber. These sleeves will be the total support of the chambers during the filling process. These sleeves will be added to each side panel prior to the production of the actual chamber. Dimensionally, the horizontal height B will always be 2 feet (0.61 meters) longer than the vertical height A. The Front Toe will always be 1 foot (0.30 meters) tall. On each end of a completed chain will be either a set of loops or an extra main panel with ties. This construction will allow chains to be tied together in the field to conform a continuous barrier of any length.

Figure 2:
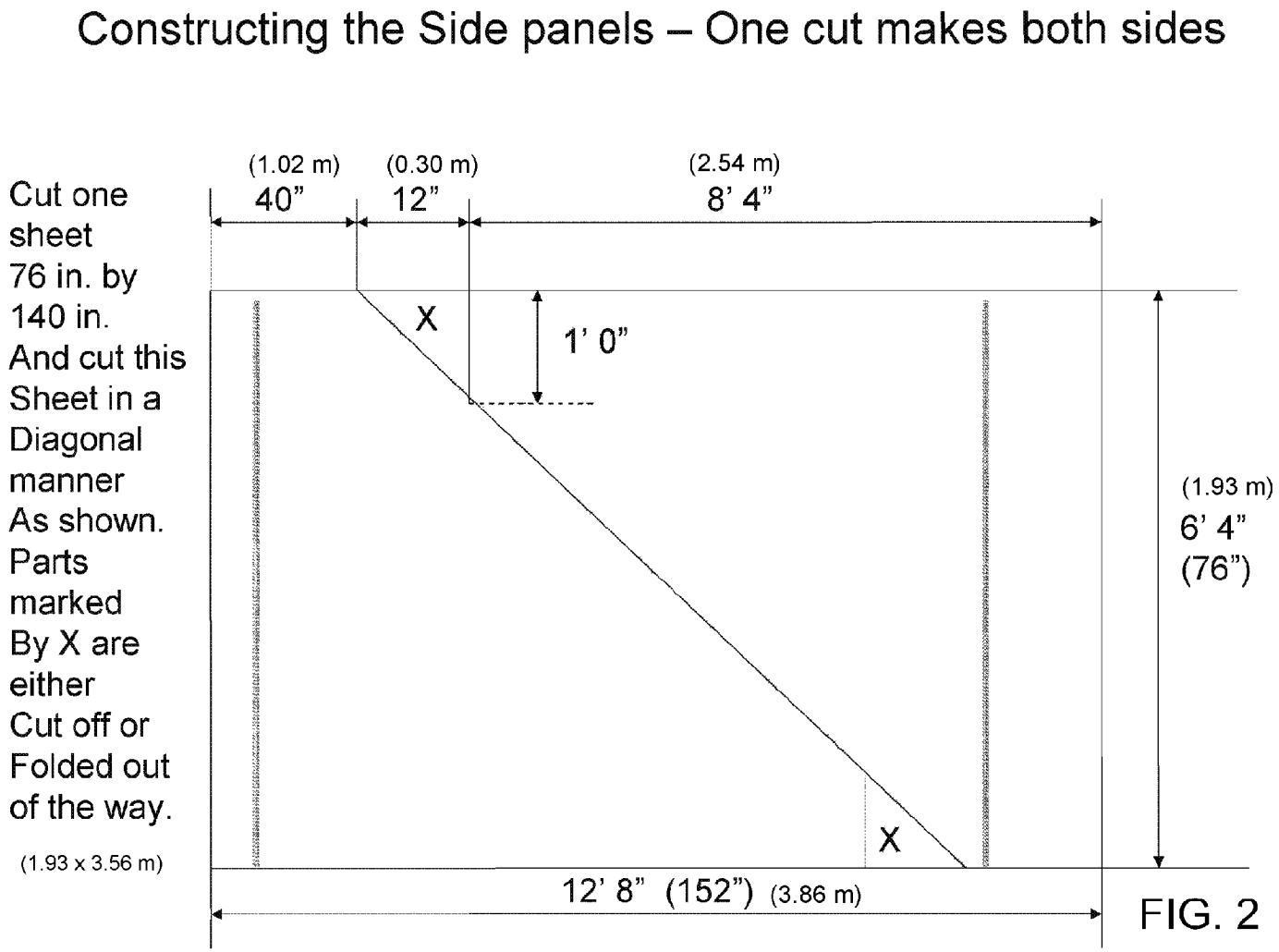
FIG. 2 illustrates the construction of the side panels in the system of the present invention.
Figure 3:
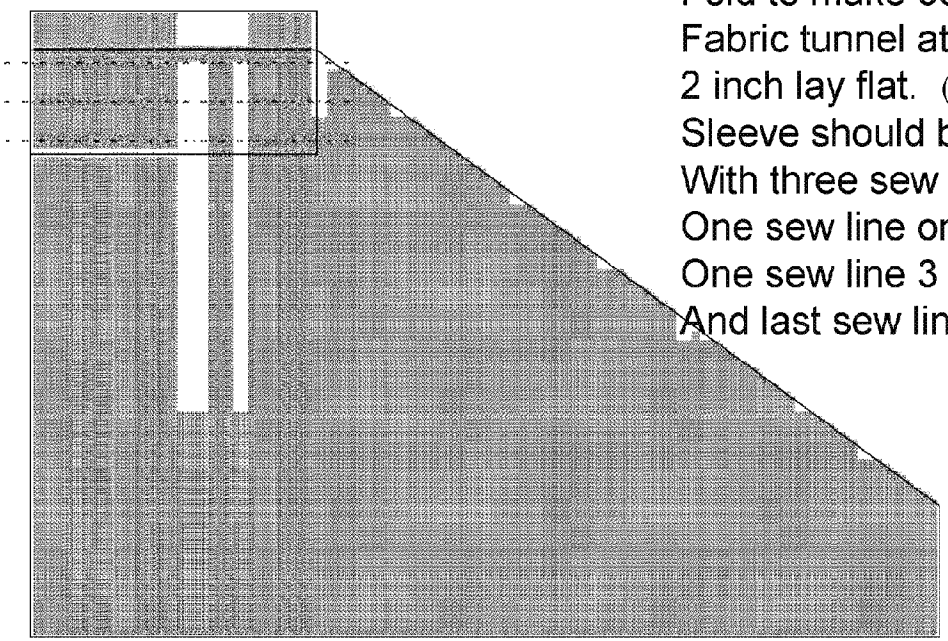
FIG. 3 illustrates the sleeve construction and attachment in the system of the present invention.

The features as summarized above are illustrated in the drawing FIGS. 1-12. FIG. 1 illustrates a plurality of the chambers engaged to one another with the dimensions of each chamber set forth in the preferred embodiment. FIG. 2 illustrates the construction of the side panels by configuring two sides from a single length of fabric cut on the diagonal as illustrated. FIG. 3 illustrates the sleeve construction and the manner of attachment as described in the drawing Figure.

Figure 4:
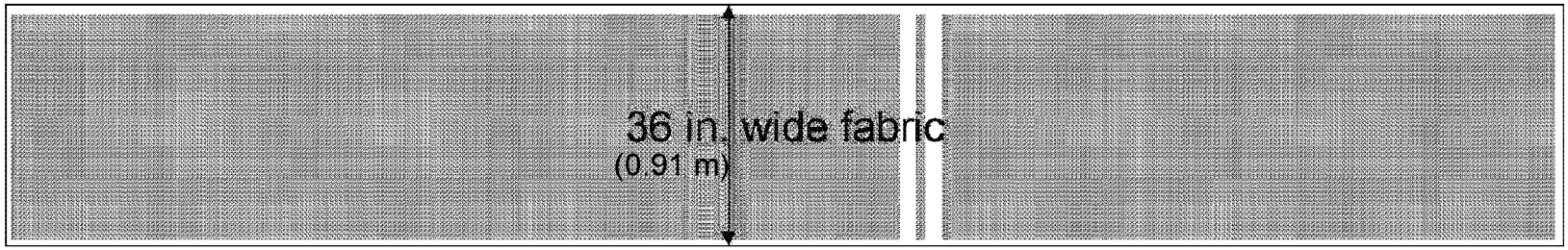
FIG. 4 illustrates the main panel construction in the system of the present invention.
Figure 5:
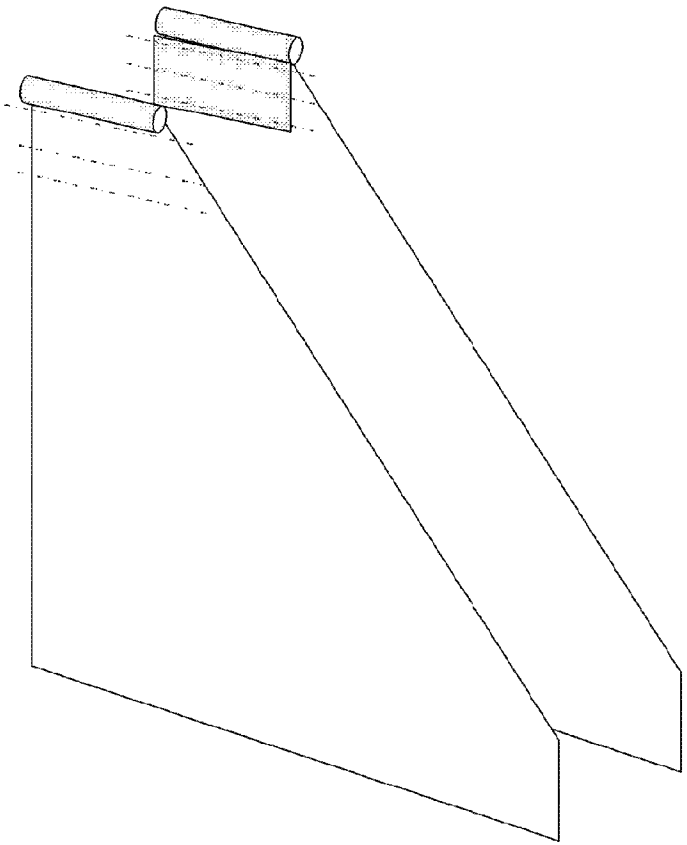
FIG. 5 illustrates the addition of sleeves to the side panels in the system of the present invention.
Figure 6:
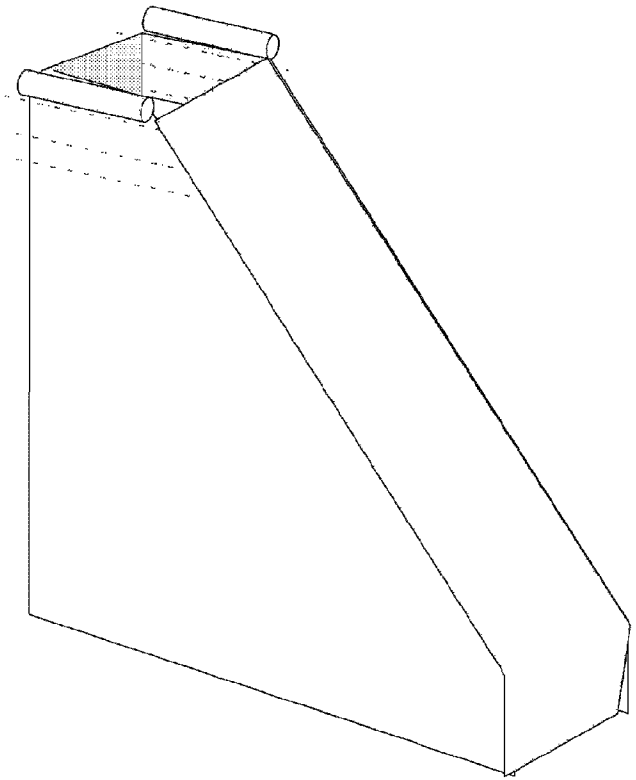
FIG. 6 illustrates the sewing of one main panel to two side panels.
Figure 7:
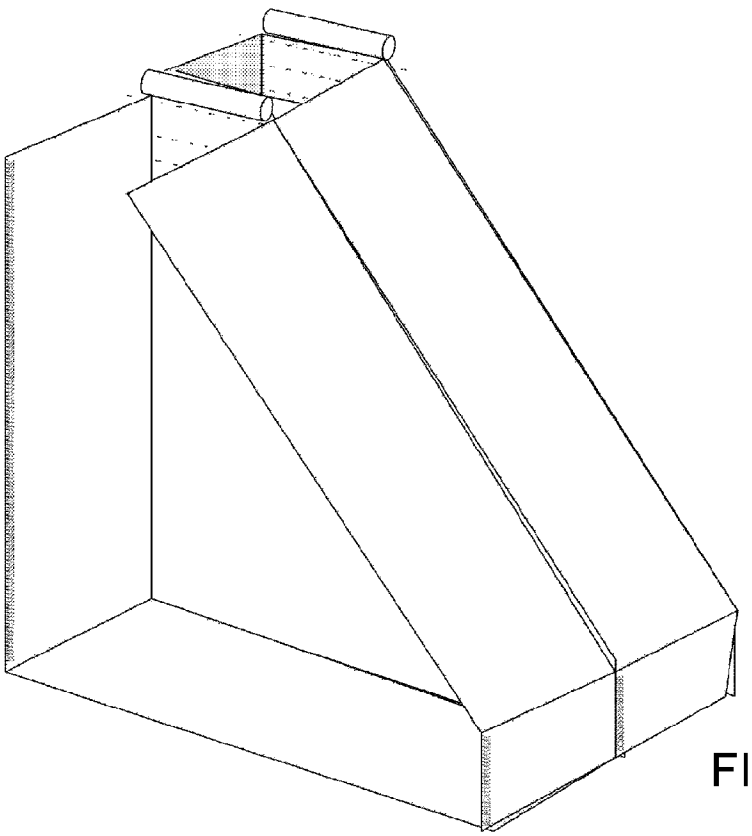
FIG. 7 illustrates adding one main panel to one completed chamber.
Figure 8:
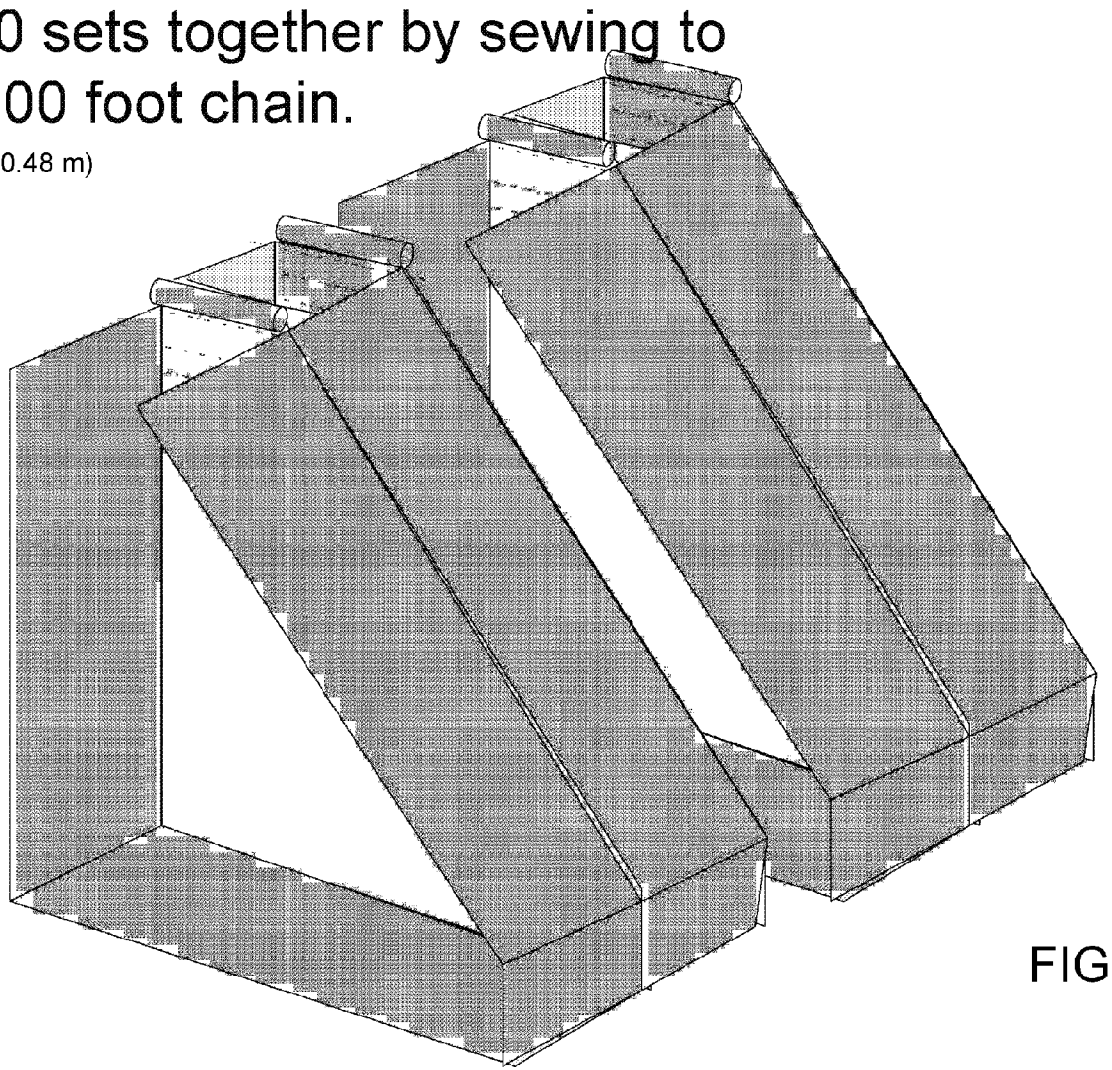
FIG. 8 illustrates linking of 20 sets together by sewing to form a 100 foot (30.48 meters) chain in the system of the present invention.
Figure 9:
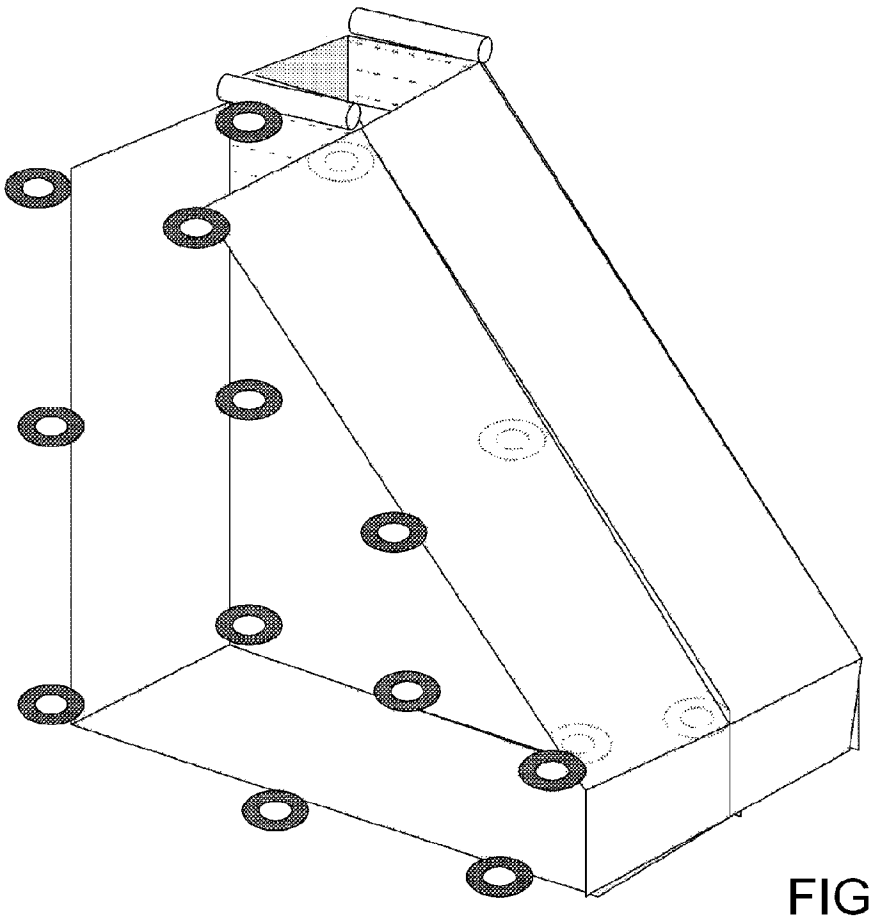
FIG. 9 illustrates preparing the connection chambers in the system of the present invention.
Figure 10:
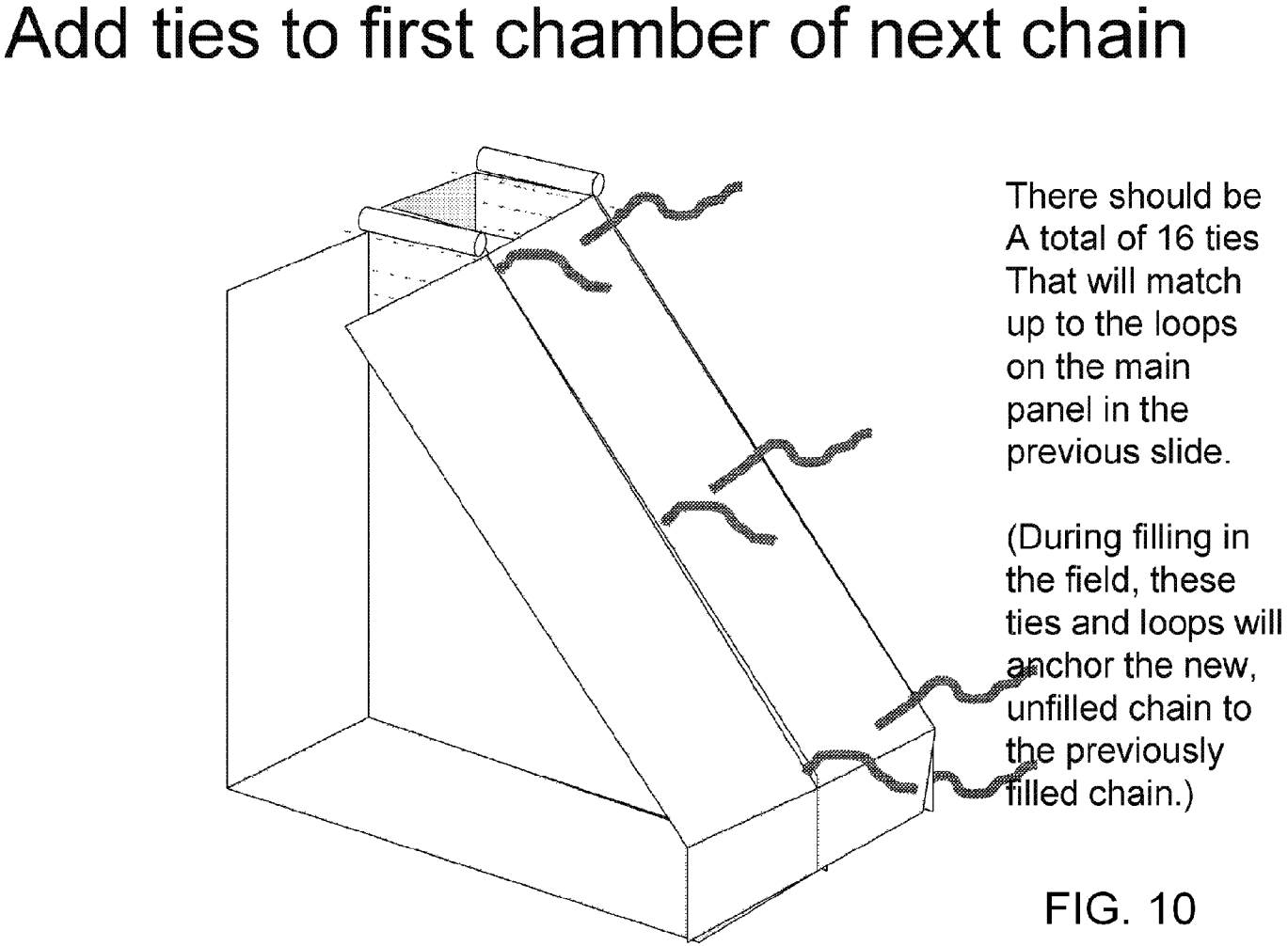
FIG. 10 illustrates adding ties to the first chamber of the next chain in the system of the present invention.
Figure 11:
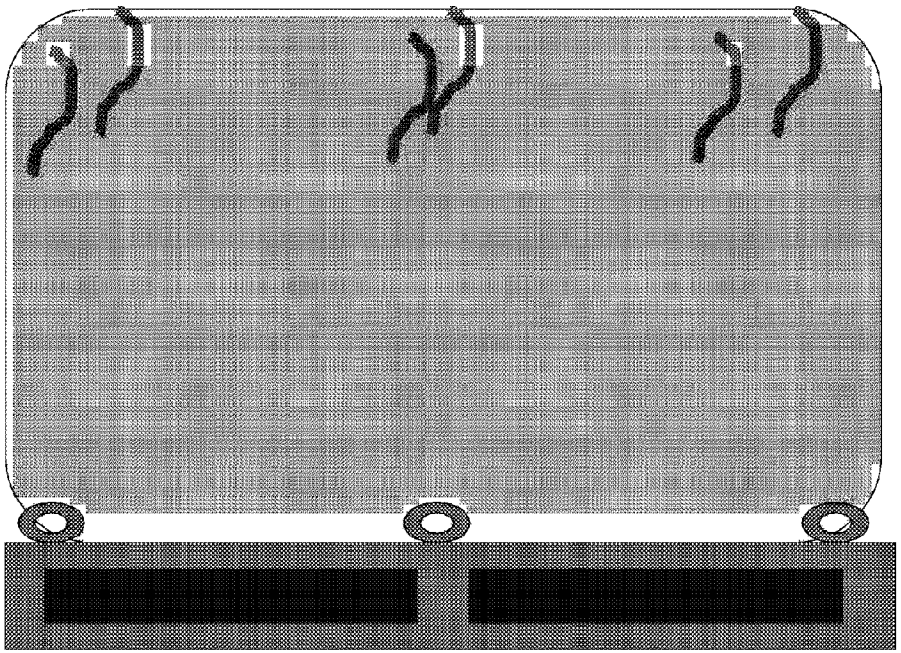
FIG. 11 illustrates packing completed chains in the system of the present invention.

FIG. 4 illustrates the main panel construction in the proper length and width as described. FIG. 5 illustrates the procedure for adding the sleeves to the side panels in the construction, while FIG. 6 illustrates the sewing of one main panel to two side panels. FIG. 7 illustrates the procedure in adding one main panel to one completed chamber as illustrated. FIG. 8 illustrates the linking together of twenty sets by sewing to form a 100 foot (30.48 meters) chain of chambers. FIG. 9 illustrates the preparation of the connection chambers by attachment of 8 loops inside the seam that attaches the main panel to the side panel, as described in the Figure. FIG. 10 illustrates the step of adding ties to the first chamber of the next chain of chambers. The sixteen ties would tie into the loops to anchor the unfilled chain to a previously filled chain of chambers. FIG. 11 illustrates the packing of the completed chain whereby each chain is always packed with the main panel with the loops down on the pallet first and the chamber with the ties on top. FIG. 12 discusses the final packing technique, where a cover bag is added, it is strapped to the pallet, and a tag is added indicating trap bag style that is six feet (1.83 meters) in height.

One of the keys to this success is the idea that these cells are all connected. The water cannot move a single cell without moving the entire line which then weighs many thousands of pounds (or kilograms). The sand bags currently being used weigh 100 pounds (45.36 kilograms) and are not connected. If the flood can move a single bag, the water starts to flow and the hole in the protection automatically grows and grows pretty vigorously.

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A non-self-standing flood wall, comprised of woven fabric interconnected cells, each cell further comprising:

a. a main fabric panel extending from the top of the cell and terminating at a forward truncated toe portion;

b. a pair of parallel sidewalls, sewn to each edge of the main fabric panel, each sidewall having a horizontal base edge, a vertical rear edge, and a front edge extending from the top of the cell at an angle to the lower edge of the truncated toe portion;

c. a vertical rear wall sewn to the rear edges of the sidewalls, defining an open ended top portion;

d. the main panel, parallel sidewalls, truncated toe portion and rear wall together define a cell having a vertical rear wall and an angulated main wall terminating at the truncated toe portion into which material can be poured to define a filled cell as part of the overall flood wall;

e. fabric sleeves positioned at the top of each sidewall into which temporary support bars can be engaged in order to maintain the cellular walls upright while the material is being poured into each cell; and f. a plurality of such cells interconnected and filled with material to define the non-self-standing flood wall.

2. The non-self-standing flood wall in claim 1, wherein one sidewall of a cell serves as the sidewall of an adjoining cell.

3. The non-self-standing flood wall in claim 1, wherein there may be included a fabric floor portion to each cell.

4. The non-self-standing flood wall in claim 1, wherein the main wall extends from the top of each cell to the truncated toe portion at around a 45 degree angle from the vertical.

5. A method of erecting a non-self-standing flood wall, comprised of woven fabric interconnected cells, comprising the following steps:

a. forming a first cell of the type comprising:

i. a main fabric panel extending from the top of the cell and terminating at a forward truncated toe portion;

ii. a pair of parallel sidewalls, sewn to each edge of the main fabric panel, each sidewall having a horizontal base edge, a vertical rear edge, and a front edge extending from the top of the cell at an angle to the lower edge of the truncated toe portion;

iii. a vertical rear wall sewn to the rear edges of the sidewalls, defining an open ended top portion;

iv. the main panel, parallel sidewalls, truncated toe portion and rear wall together define a cell having a vertical rear wall and an angulated main wall terminating at the truncated toe portion into which material can be poured to define a filled cell as part of the overall flood wall;

v. fabric sleeves positioned at the top of each sidewall;

b. connecting at least a second cell to the initial cell, so that the two cells share a common wall;

c. supporting the two cells with support bars engaged through the fabric sleeves;

d. pouring a quantity of material into each supported cell until each cell is filled with material;

e. forming additional interconnected cells of the type defined in step (a);

f. supporting each additional cell and filling each cell with material in order to form a first chain of cells of the flood wall system.

6. The method in claim 5, further comprising the step of providing a set of loops or ties on an end of the first chain of cells so that a second erected chain of chambers is capable of being tied to the first chains of chambers to define a continuous flood wall system.

7. The method in claim 5, wherein each chain of cells is positioned so that flood waters engage the angulated front panel of each cell to maintain the chain upright against a force of flood waters.

8. A non-self-standing flood wall of interconnected woven fabric cells, each cell comprising:

a. a pair of parallel wall portions, a main front portion, a rear portion, all sewn together to define an open topped fabric cell;

b. fabric sleeves sewn to the top of each parallel wall portion sized to hold temporary support bars that maintain the cell upright and protects the wall portion from the weight of the fill material being poured into the open top to fill the cell; and c. wherein the main front portion extends from the top of the cell at an angle and terminates in a truncated toe portion at a forward end of each cell so that the material poured into the cell fills the entire cell and does not leave a portion of the lower end of the cell with an undesirable void of material.

9. The non-self-standing flood wall in claim 8, further comprising means to interconnect a plurality of individual cells together to define a portion of the flood wall when each cell is filled with material.

10. The non-self-standing flood wall in claim 8, wherein a plurality of two or more portions of the flood wall interconnected defines the entire flood wall.

11. A non-self-standing flood wall, comprised of woven fabric interconnected cells, each cell further comprising:

a. a main fabric panel extending from the top of the cell and terminating at a forward toe portion;

b. a pair of parallel sidewalls, sewn to each edge of the main fabric panel, each sidewall having a horizontal base edge, a vertical rear edge, and a front edge extending from the top of the cell at an angle to the lower edge of the toe portion;

c. a vertical rear wall sewn to the rear edges of the sidewalls, defining an open ended top portion;

d. the main panel, parallel sidewalls, toe portion and rear wall together define a cell having a vertical rear wall and an angulated main wall terminating at the toe portion into which material can be poured to define a filled cell as part of the overall flood wall;

e. fabric sleeves positioned at the top of each sidewall into which temporary support bars can be engaged in order to maintain the cellular walls upright while the material is being poured into each cell; and f. a plurality of such cells interconnected and filled with material to define the non-self-standing flood wall.

12. The non-self-standing flood wall in claim 11, wherein the toe portion comprises a truncated toe portion.

* * * * *